US009046806B2

(12) United States Patent
Souda

(10) Patent No.: US 9,046,806 B2
(45) Date of Patent: Jun. 2, 2015

(54) ELECTRODE FOR IMAGE FORMING APPARATUS AND IMAGE FORMING APPARATUS

(71) Applicant: BROTHER KOGYO KABUSHIKI KAISHA, Nagoya-shi, Aichi-ken (JP)

(72) Inventor: Makoto Souda, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 25 days.

(21) Appl. No.: 13/748,285

(22) Filed: Jan. 23, 2013

(65) Prior Publication Data

US 2013/0188982 A1 Jul. 25, 2013

(30) Foreign Application Priority Data

Jan. 23, 2012 (JP) ..... 2012-011277

(51) Int. Cl.

| | |
|---|---|
| ***G03G 15/00*** | (2006.01) |
| ***G03G 15/02*** | (2006.01) |
| ***G03G 21/16*** | (2006.01) |
| ***G03G 21/18*** | (2006.01) |

(52) U.S. Cl.

CPC ..... *G03G 15/0266* (2013.01); *G03G 21/1652* (2013.01); *G03G 21/1867* (2013.01)

USPC ..... 399/90; 439/700; 267/179

(58) Field of Classification Search

CPC ..... G03G 21/1652; G03G 21/1867

USPC ..... 399/90; 439/700; 267/169, 179

See application file for complete search history.

(56) References Cited

U.S. PATENT DOCUMENTS

| | | | | |
|---|---|---|---|---|
| 2,051,670 | A * | 8/1936 | Anton | 15/267 |
| 5,692,599 | A * | 12/1997 | Winter | 200/401 |
| 7,654,859 | B2 * | 2/2010 | Cheng | 439/500 |
| 8,038,483 | B2 | 10/2011 | Souda | |
| 8,561,330 | B2 * | 10/2013 | Siegenthaler et al. | 40/604 |
| 2001/0041079 | A1 * | 11/2001 | Michlin et al. | 399/90 |
| 2007/0154232 | A1 * | 7/2007 | Buchanan et al. | 399/90 |

(Continued)

FOREIGN PATENT DOCUMENTS

| | | | |
|---|---|---|---|
| CN | 2906694 | Y | 5/2007 |
| CN | 101673890 | A | 3/2010 |

(Continued)

OTHER PUBLICATIONS

U.S. Office Action issued in related U.S. Appl. No. 14/040,564, mailed Jul. 8, 2014.

(Continued)

*Primary Examiner* — Christ Mahoney

(74) *Attorney, Agent, or Firm* — Merchant & Gould PC

(57) ABSTRACT

An electrode for an image forming apparatus, the electrode including: an elastically deformable spring portion that is formed in a cylindrical shape by spirally winding a wire; a ring portion that is an electrical contact portion having an annular shape and provided to one end side of the spring portion in an axial direction of the spring portion, the ring portion being formed by winding the wire around a center line, which intersects with the axial direction of the spring portion, at least twice; an inner portion that is formed by the wire forming the ring portion and is positioned at an inside of the ring portion; and an outer portion that is formed by the wire forming the ring portion and is positioned at an outside of the ring portion.

20 Claims, 9 Drawing Sheets

(56) References Cited

U.S. PATENT DOCUMENTS

| | | | | |
|---|---|---|---|---|
| 2010/0239306 | A1* | 9/2010 | Souda | 399/107 |
| 2011/0065336 | A1 | 3/2011 | Souda | |
| 2013/0084081 | A1 | 4/2013 | Itabashi et al. | |
| 2014/0112679 | A1 | 4/2014 | Choi | |

FOREIGN PATENT DOCUMENTS

| | | | |
|---|---|---|---|
| EP | 1953603 | A1 | 8/2008 |
| JP | 11-249362 | A | 9/1999 |
| JP | 2002-124231 | A | 4/2002 |
| JP | 2004-250174 | A | 9/2004 |
| JP | 2011-064925 | A | 3/2011 |
| WO | 2010/050613 | A1 | 5/2010 |

OTHER PUBLICATIONS

U.S. Office Action issued in related U.S. Appl. No. 14/040,564, mailed Nov. 19, 2014.

Chinese Office Action in related application No. 201310025207, mailed Dec. 26, 2014.

Office Action issued in related Japanese application No. 2012-011277, mailed Mar. 10, 2015.

* cited by examiner 31
31A
31B
31D
31G
31H
L1
L2
L3
T
D1
D2
D3
O1
d
31E(31D)
31F(31D)

ELECTRODE FOR IMAGE FORMING APPARATUS AND IMAGE FORMING APPARATUS

CROSS-REFERENCE TO RELATED APPLICATIONS

This application claims priority from Japanese Patent Application No. 2012-011277 filed on Jan. 23, 2012, the entire contents of which are incorporated herein by reference.

TECHNICAL FIELD

One or more aspects of the present invention relates to an electrode for an image forming apparatus, and an image forming apparatus using the electrode.

BACKGROUND

As an example, an electrode for an image forming apparatus disclosed in JP-A-2011-64925 includes a spring portion formed by winding a wire in a coiled shape (a spiral shape), and an electrical contact portion formed by winding the wire in an annular shape.

The above-mentioned electrical contact portion is formed by winding the wire twice such that adjacent positions of the wire are in close contact. For this reason, if the electrical contact portion having the annular shape is seen from a direction perpendicular to the center line of the electrical contact portion, two portions of the wire are aligned in parallel while being in close contact with each other.

SUMMARY

However, in a case of assembling the electrode in an image forming apparatus or in a case of conveying the single electrode, an external force may act on the electrical contact portion. If an external force acts on the electrical contact portion, two adjacent portions of the wire shift to be twisted. As a result, if the electrical contact portion is seen from a direction perpendicular to the center line of the electrical contact portion, two adjacent portions of the wires intersect with each other.

Further, if two portions of the wire intersect with each other, as compared to a state where two portions of the wire are aligned in parallel in a close contact state, a contact area between the electrical contact portion and a member which contacts with the electrical contact portion is reduced, and therefore, a contact failure is more likely to be caused.

In view of the above-described problem, an aspect of the present invention is to provide a new electrode capable of suppressing adjacent portions of a wire from shifting to be twisted, even if an external force acts on an electrical contact portion.

According to an aspect of the present invention, there is provided an electrode for an image forming apparatus. The electrode includes: an elastically deformable spring portion, a ring portion, an inner portion and an outer portion. The elastically deformable spring portion is formed in a cylindrical shape by spirally winding a wire. The ring portion is an electrical contact portion having an annular shape and provided to one end side of the spring portion in an axial direction of the spring portion, the ring portion being formed by winding the wire around a center line, which intersects with the axial direction of the spring portion, at least twice. The inner portion is formed by the wire forming the ring portion and is positioned at an inside of the ring portion. The outer portion is formed by the wire forming the ring portion and is positioned at an outside of the ring portion.

According to another aspect of the present invention, there is provided an electrode for an image forming apparatus. The electrode includes: an elastically deformable spring portion, a ring portion, an inner portion and an outer portion. The elastically deformable spring portion includes a wire which is wound spirally. The ring portion includes the wire wound around a center line, which intersects with an axial direction of the spring portion, at least twice, and is provided to one end side of the spring portion in the axial direction of the spring portion. The inner portion includes the wire and is positioned at an inside of the ring portion. The outer portion includes the wire and is positioned at an outside of the ring portion.

Accordingly, in the present invention, even if an external force acts on the ring portion (31B) such that adjacent portions of the wire of the ring portion deviate from each other in a direction perpendicular to the center line, the inner portion (31E) or the outer portion (31F) is locked to the adjacent portions of the wire (31C). Therefore, it is possible to suppress adjacent portions of the wire from being twisted and shifting to intersect with each other.

Therefore, even if an external force acts on the electrical contact portion, that is, the ring portion (31B), it is possible to obtain an electrode capable of suppressing adjacent portions of the wire (31C) from shifting to be twisted.

It is to be noted that the reference symbols noted in the brackets in the description described above only indicate their correlations with specific means and the like in the exemplary embodiments to be described later, and the present invention is not limited thereto.

DETAILED DESCRIPTION

Embodiments of the present invention to be described hereinafter represent examples of embodiments. In other words, invention identifying matters and the like defined in the claims are not limited to specific means and structures and the like disclosed in the following exemplary embodiments.

Further, the present exemplary embodiments were obtained by applying the present invention to an electrographic type image forming apparatus. Hereinafter, exemplary embodiments of the present invention will be described with reference to the accompanying drawings.

First Exemplary Embodiment

1. Brief Description of Image Forming Apparatus

Figure 1:
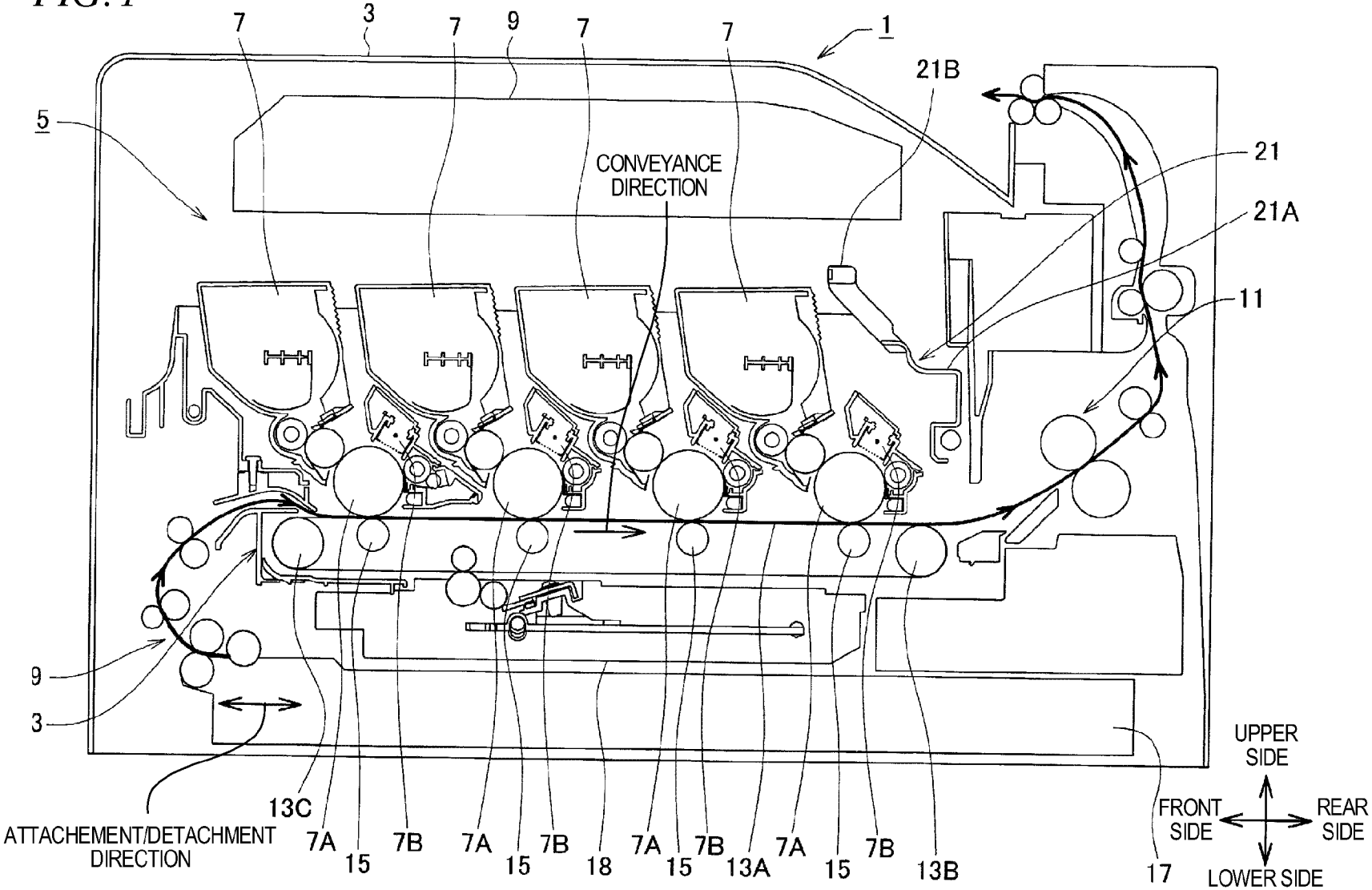
FIG. 1 is a schematic view illustrating the center section of an image forming apparatus according to an exemplary embodiment of the present invention.

Inside a housing 3 of an image forming apparatus 1, as shown in FIG. 1, an image forming unit 5 is stored for transferring developer images onto a sheet such as a recording paper sheet, thereby forming an image on the sheet. The image forming unit 5 includes process units 7, an exposing unit 9, a fixing unit 11, and so on.

The image forming unit 5 according to the present exemplary embodiment is a direct tandem type image forming means including a plurality of (four in the present exemplary embodiment) process units 7 disposed in series along a sheet conveyance direction.

The individual process units 7 are different only in the colors of developer stored therein, and are substantially the same in their structures and so on. Specifically, each process unit 7 includes a photosensitive drum 7A for carrying a developer image thereon, a charging unit 7B for charging the photosensitive drum 7A, and so on.

At positions facing the photosensitive drums 7A with a transfer belt 13A interposed therebetween, transfer rollers 15 are disposed for transferring the developer carried on the photosensitive drums 7A onto a sheet. To these transfer rollers 15, a voltage is applied for transferring developer images carried on the photosensitive drums 7A onto a sheet.

Then, the developer images carried on the individual photosensitive drums 7A are transferred onto a sheet conveyed on the transfer belt 13A such that the developer images overlap. The fixing unit 11 heats the developer transferred on the sheet, thereby welding the developer on the sheet.

The transfer belt 13A is an endless belt which is suspended between a drive roller 13B and a driven roller 13C, and rotates together with the rollers 13B and 13C. Further, the transfer belt 13A, the drive roller 13B, the driven roller 13C, a frame (not shown) for supporting those rollers 13A and 13B, etc. configures a belt unit 13. The belt unit 13 is detachably mounted to an apparatus main body.

Below the belt unit 13, a sheet feed tray 17 is disposed to allow sheets to be stacked therein. Sheets stacked in the sheet feed tray 17 are conveyed toward the image forming unit 5, one by one, by a feeder mechanism 19. The sheet feed tray 17 according to the present exemplary embodiment is detachably mounted to the apparatus main body.

Figure 2:
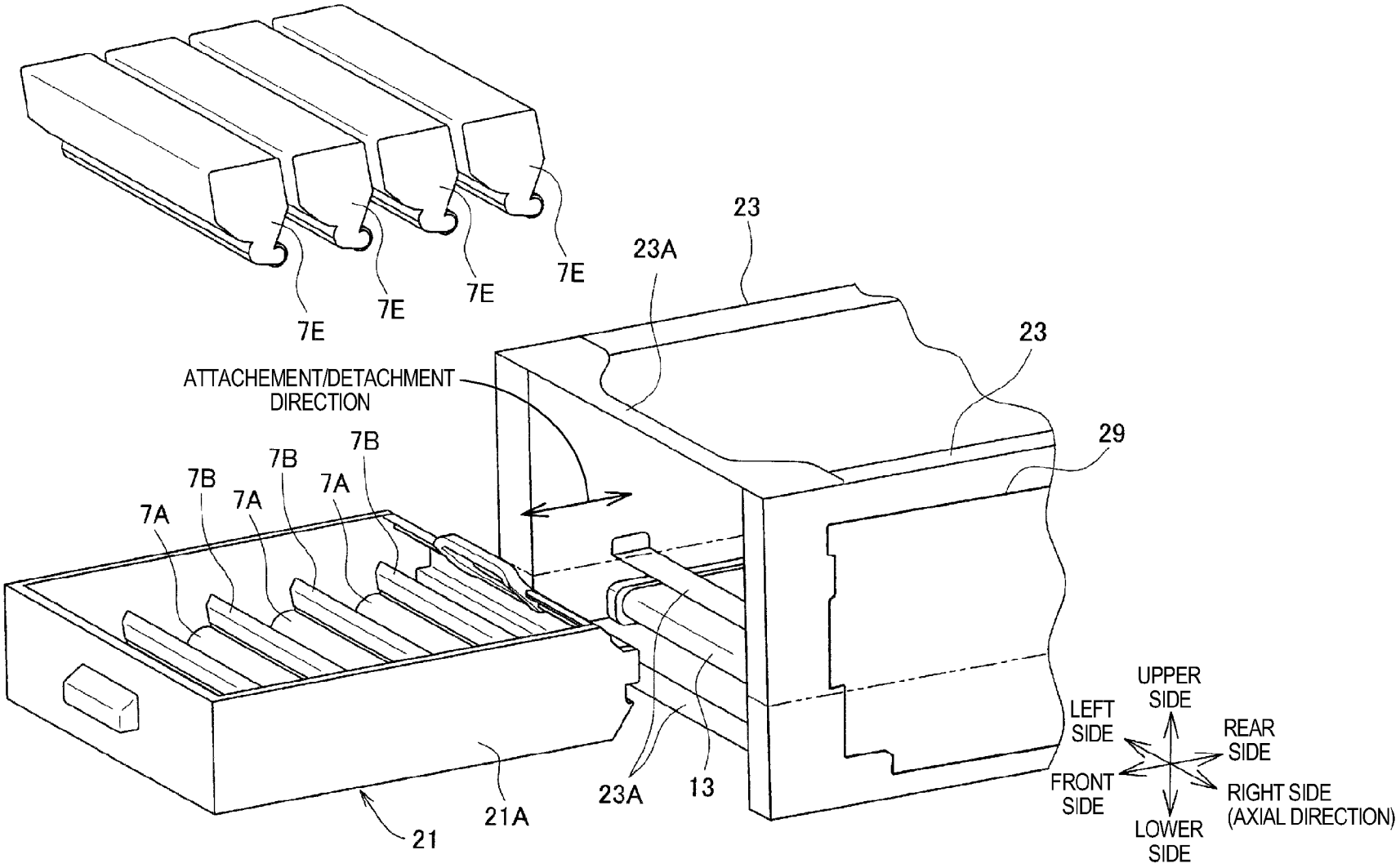
FIG. 2 is an explanatory view illustrating attachment and detachment of a drawer unit 19 with respect to an apparatus main body according to the exemplary embodiment of the present invention.

In the present exemplary embodiment, the individual process units 7 are assembled in a drawer casing 21A, whereby a drawer unit 21 is configured. As shown in FIG. 2, this drawer unit 21 is configured to be movable in a direction parallel to the plate surfaces of first electric boards 29, and is mounted to the apparatus main body such that the drawer unit 21 is extractable from the apparatus main body. Therefore, in the present exemplary embodiment, it is possible to integrally insert and extract the four process units 7 with respect to the apparatus main body.

It is to be noted that the "apparatus main body" means a portion of the image forming apparatus which is not disassembled or attached or detached during normal use, such as substantially plate-like main frames 23, which are provided on both sides in a width direction with the image forming unit 5 interposed therebetween, and the housing 3. The width direction means a direction perpendicular to the sheet conveyance direction and a sheet thickness direction. The plate surfaces of the first electric boards 29 mean virtual plate surfaces of the first electric boards 29 formed in substantially plate shapes. In the present exemplary embodiment, the width direction corresponds to the left-right direction.

The photosensitive drums 7A of the process units 7 are assembled inside the drawer casing 21A such that they are aligned in series in the sheet conveyance direction, whereby their axial directions are perpendicular to the sheet conveyance direction. Meanwhile, each process unit 7 includes a cartridge unit 7E which has a storage portion filled with the developer, and the like, and is mounted with respect to the drawer casing 21A such that the cartridge unit 7E is detachable. Therefore, it is possible to supplement the developer only by drawing the drawer unit 21 from the apparatus main body and exchanging only the cartridge unit 7E.

Figure 3:
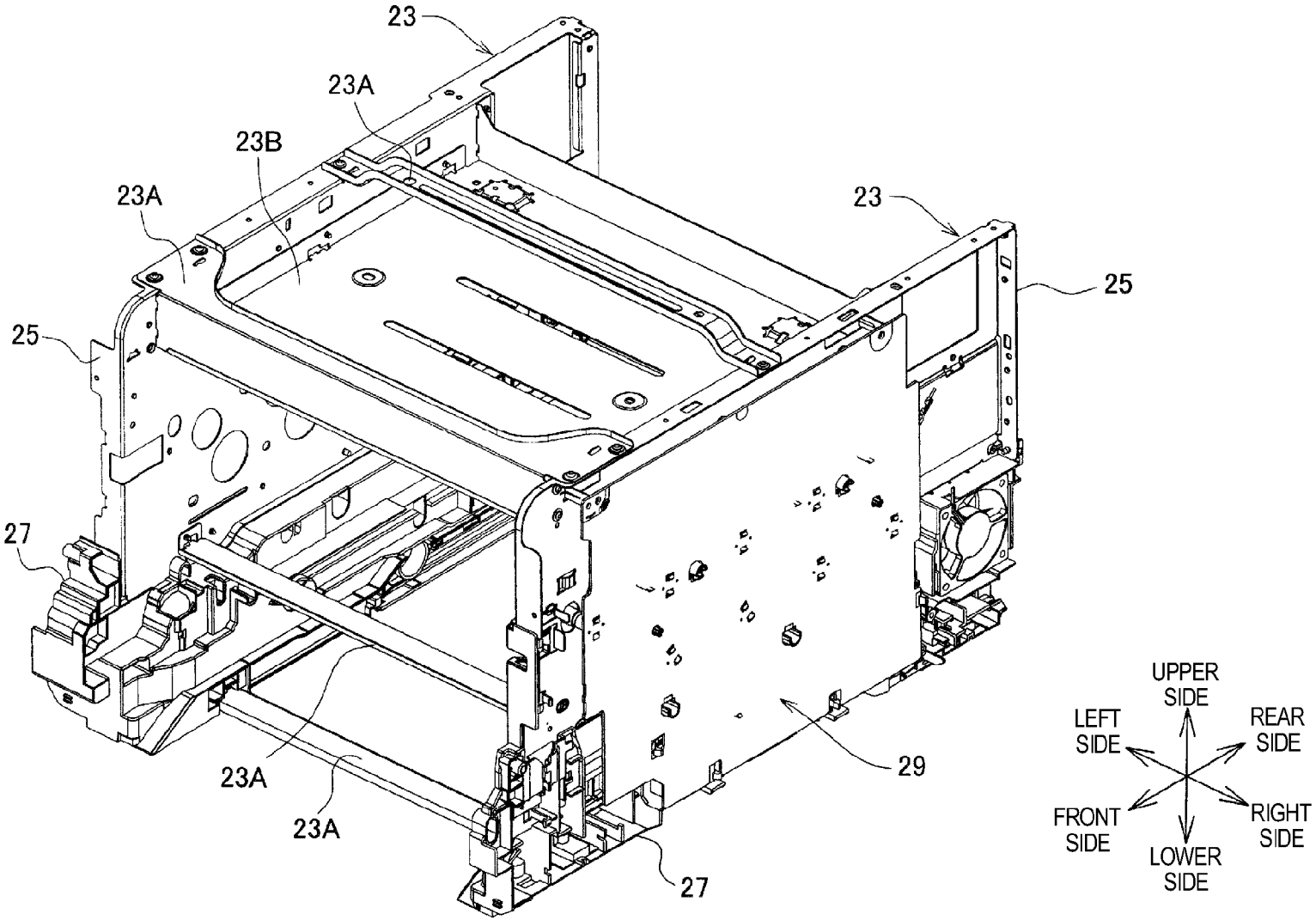
FIG. 3 is a perspective view illustrating main frames 23 and the like according to the exemplary embodiment of the present invention.

2. Configuration of Main Frames, Electric Boards, Board-side Electrode Portion, and so on As shown in FIG. 3, each of pair of main frames 23 includes a first frame 25 that is formed with an iron-based metal such as SPCC, a second frame 27 that is disposed below the first frame 25 and is formed with a resin such as ABS resin, and so on. The first frame 25 and the second frame 27 are connected and fixed at a plurality of positions (three positions in the present exemplary embodiment) by a mechanical fastening means such as screws, such that they are separable.

The pair of main frames 23 are connected through a beam-like bridge frame 23A disposed to extend between the both main frames 23, and a top board 23B disposed on an upper end side, and the like, whereby a rigid-frame structure is formed.

Figure 4:
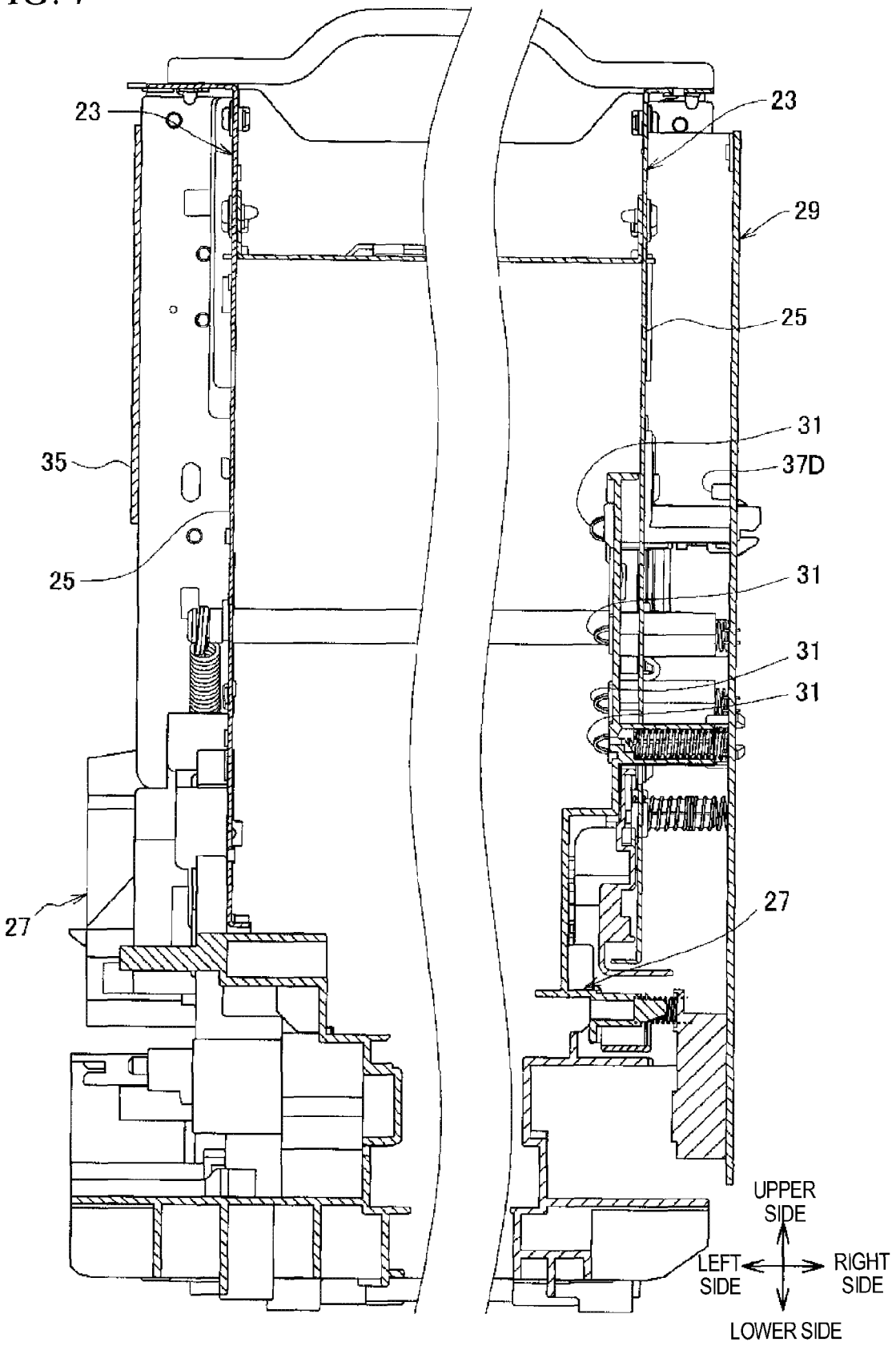
FIG. 4 is a cross-sectional view corresponding to a section in the left-right direction (width direction) of FIG. 3.

On the right main frame 23 of the pair of main frames 23, as shown in FIG. 4, a substantially plate-shaped first electric board 29 is disposed to supply electric power to the image forming unit 5, that is, the photosensitive drums 7A, the charging units 7B, the transfer rollers 15, and the like. Meanwhile, on the left main frame 23, a second electric board 35 is disposed to supply electric power to an electric motor (not shown) for supplying a driving force to various rollers.

Figure 5:
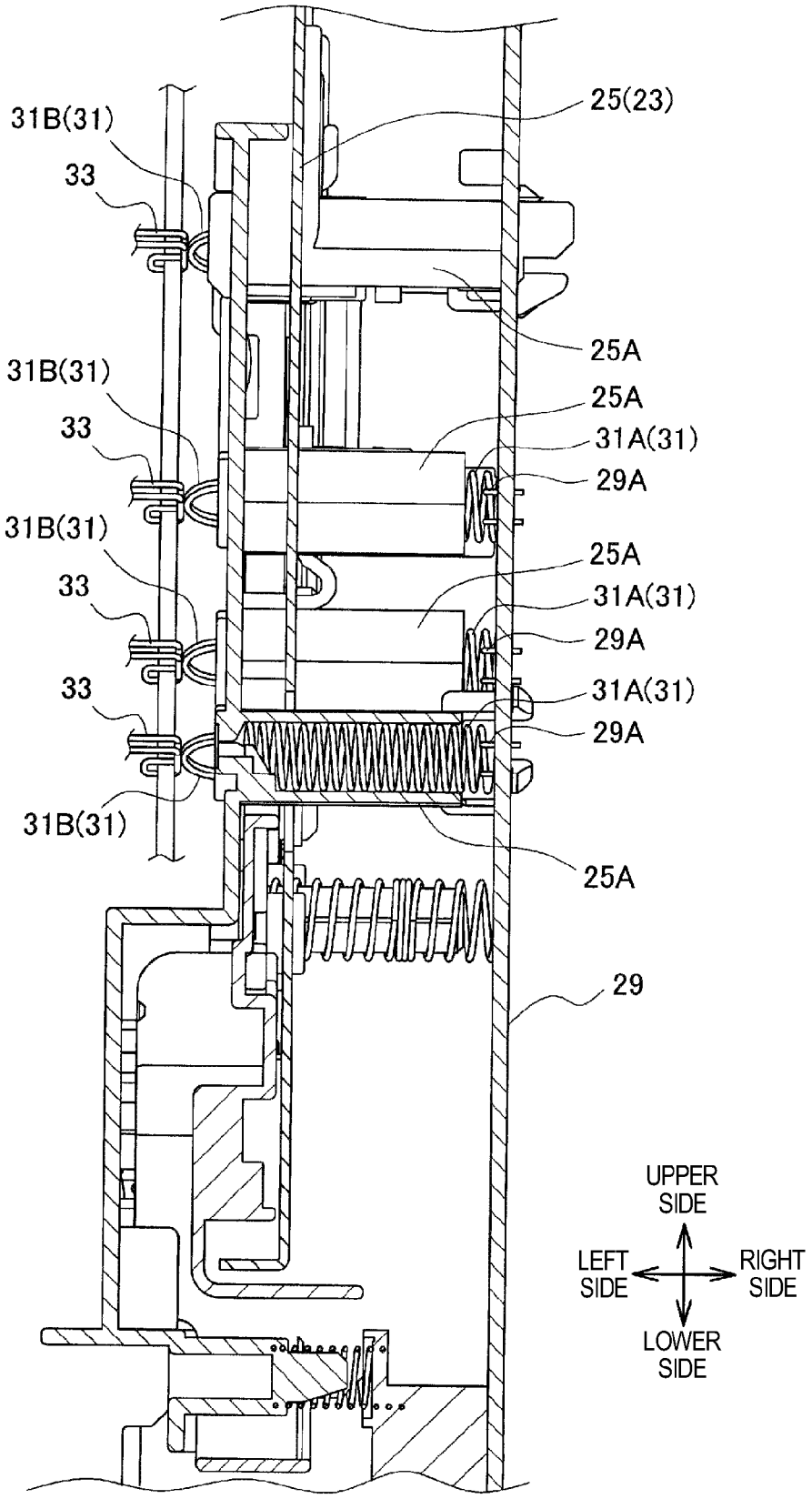
FIG. 5 is an enlarged view illustrating a portion of FIG. 4.

On the first electric board 29 side, a plurality of board-side electrode portions 31 is provided to protrude from a wall surface of the left main frame 23 toward the left main frame 23, that is, toward the image forming unit 5. These board-side electrode portions 31 are in contact with a plurality of image-formation-side electrode portions 33 provided on the image forming unit 5 or the like, as shown in FIG. 5. In the present exemplary embodiment, the board-side electrode portions 31 are respectively made by bending a piece of metal wire 31C, which will be described later. However, the invention is not limited thereto.

Figures 6A, 6B:
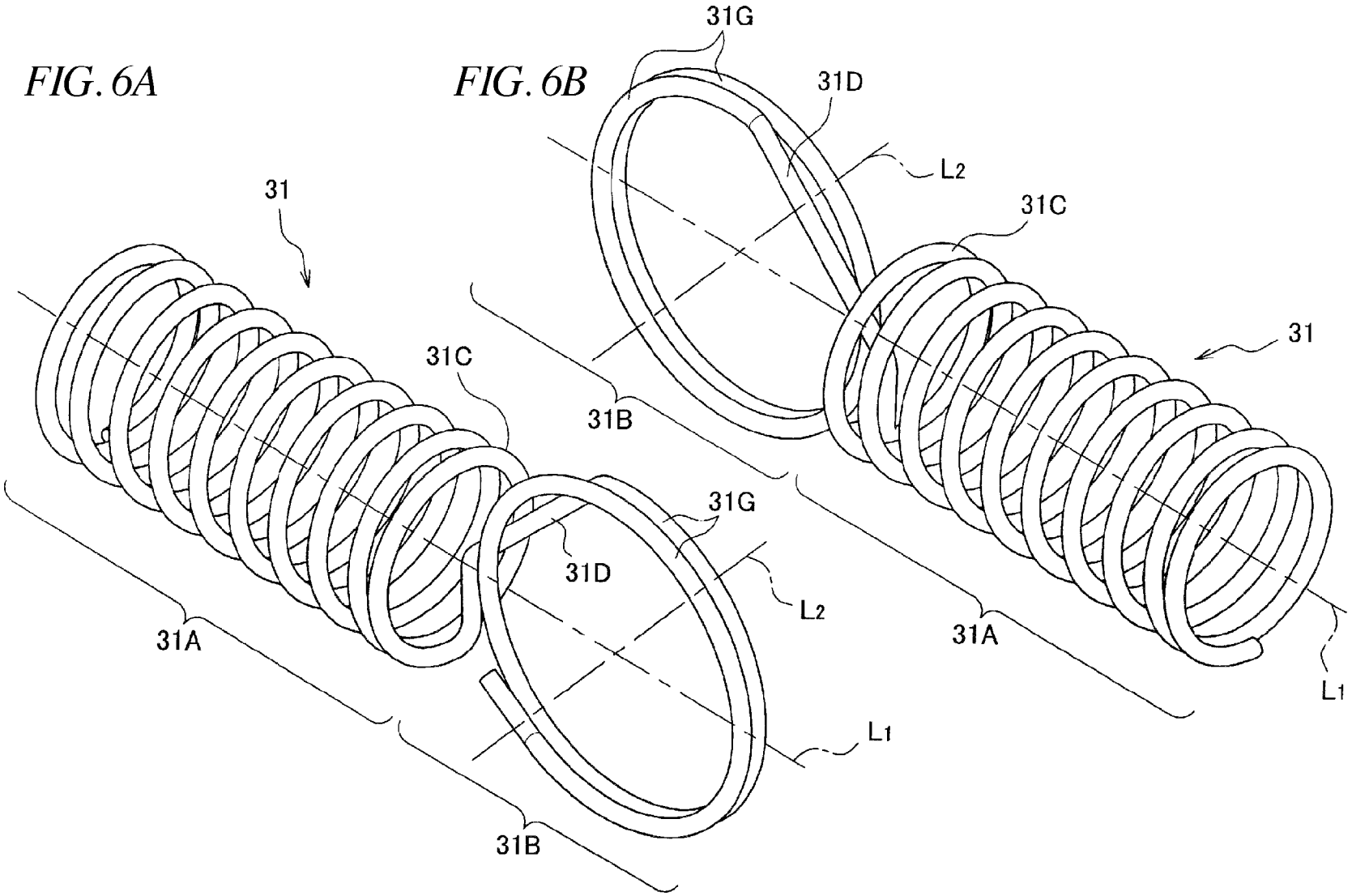
FIG. 6 (6A, 6B) is a perspective view illustrating a board-side electrode portion according to a first exemplary embodiment of the present invention.

The board-side electrode portion 31 includes a coil-shaped spring portion 31A, an electrical contact portion 31B that is provided at one end side in the axial direction of the spring portion 31A and contacts with a corresponding image-formation-side electrode portion 33, and so on. The spring portion 31A is a coil spring, which is formed in a cylindrical shape by spirally winding the wire 31C as shown in FIG. 6 (6A, 6B), and is elastically deformable.

The electrical contact portion 31B is formed by winding the wire 31C in a ring shape around its center line L2, which is a direction perpendicular to the axial direction L1 of the spring portion 31A, at least twice. Therefore, the electrical contact portion 31B will hereinafter be referred to as a ring portion 31B.

Figures 7A, 7B, 7C, 7D, 7E:
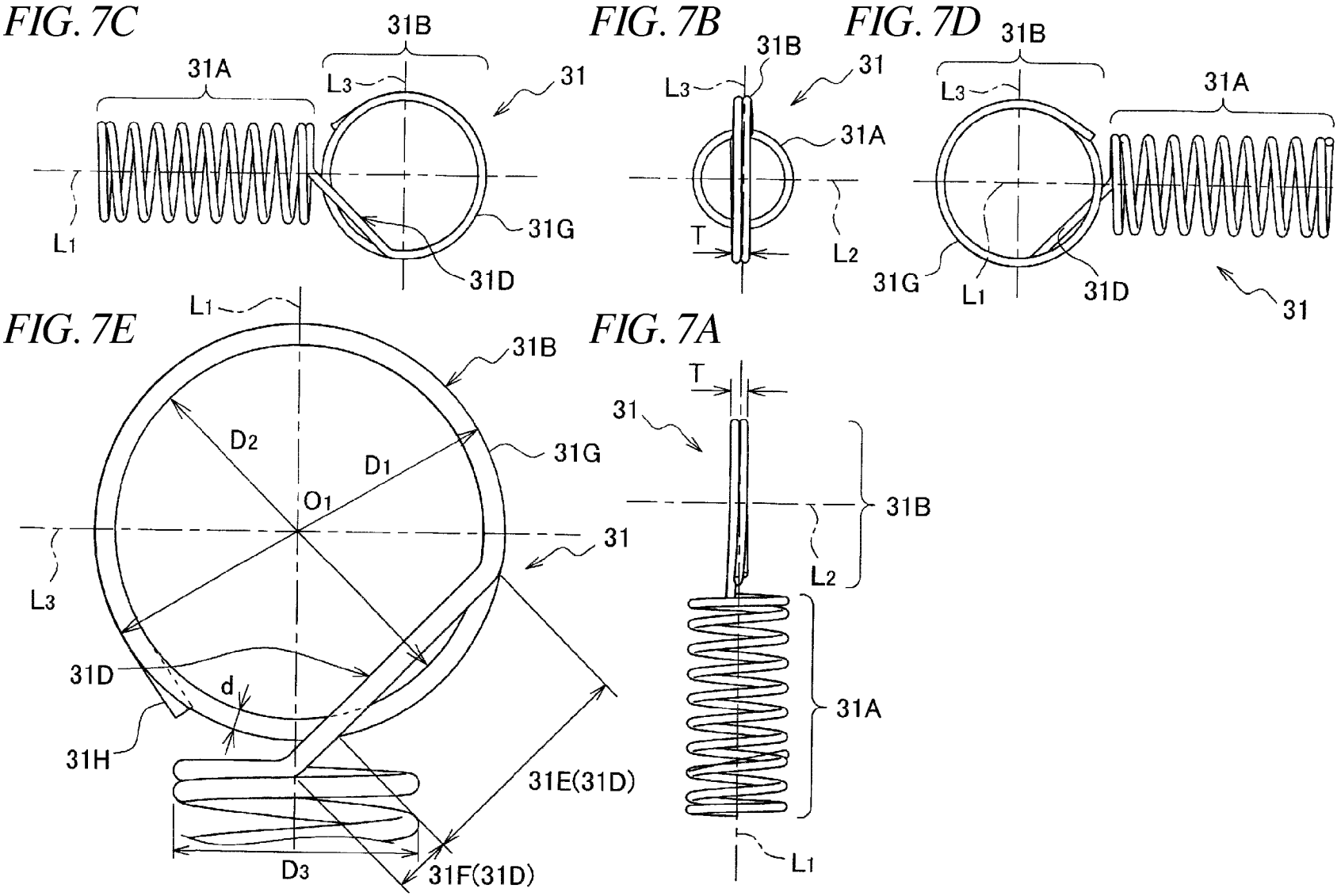
FIG. 7A is a front view of the board-side electrode portion.
FIG. 7B is a top view of FIG. 7A.
FIG. 7C is a left side view of FIG. 7B.
FIG. 7D is a right side view of FIG. 7B.
FIG. 7E is an enlarged view illustrating a ring portion 31B.

As shown in FIGS. 7C and 7D, the ring portion 31B includes a straight portion 31D, which extends straightly from one end side in the axial direction of the spring portion and is inclined at about 45 degrees with respect to the axial direction L1, and an annular portion 31G that is curved in an arc shape from the end of the straight portion 31D in the extending direction of the straight portion.

As shown in FIG. 7E, the straight portion 31D includes an inner portion 31E and an outer portion 31F which are connected to each other in a straight shape. Therefore, a portion connecting the inner portion 31E and the outer portion 31F intersects with the ring portion 31B while being in contact with the ring portion 31B.

The inner portion 31E extends in a straight shape at an inside of the ring portion 31B, like a string connecting two different points of the ring portion 31B. The outer portion 31F extends in a straight shape from the inner portion 31E toward the spring portion 31A, is positioned at an outside of the ring portion 31B, and connects the spring portion 31A and the ring portion 31B.

Further, the inner portion 31E and the outer portion 31F, that is, the straight portion 31D deviates with respect to the ring portion 31B in a direction L3 perpendicular to the center line L2. Specifically, the inner portion 31E deviates inward with respect to the ring portion 31B in the direction L3. Meanwhile, the outer portion 31F deviates outward with respect to the ring portion 31B in the direction L3.

Therefore, if the ring portion 31B is seen from its radial direction, as shown in FIGS. 7A and 7B, the straight portion 31D falls within a range defined by the thickness T of the ring portion 31B, and does not protrude with respect to the ring portion 31B in the direction of the center line L2. Since the ring portion 31B according to the present exemplary embodiment is formed by winding the wire 31C in a close contact state, twice, the thickness T of the ring portion 31B is twice the wire diameter d of the wire 31C.

Further, the straight portion 31D is provided at the spring portion 31A side with respect to the center O1 of the ring portion 31B as shown in FIG. 7E. An outer diameter D1 of the ring portion 31B is larger than an outer diameter D3 of the spring portion 31A, and if an average diameter Do of the ring portion 31B is divided by a wire diameter d of the wire 31C, a value equal to or larger than 15 is obtained. Also, the average diameter Do of the ring portion 31B is the arithmetic average of the outer diameter D1 of the ring portion 31B and the inside diameter dimension D2 of the ring portion 31B (that is, (D1+D2)/2).

A terminal end portion 31H of the wire 31C forming the ring portion 31B becomes a straight shape such that the terminal end portion 31H extends in a tangential direction from the ring portion 31B. The terminal end portion 31H is a portion of the wire 31C which is clamped (chucked) when the ring portion 31B is formed. In the present exemplary embodiment, the terminal end portion 31H is also used as a portion fulfilling the same functions as those of the above-mentioned outer portion 31F.

Meanwhile, as shown in FIG. 5, in a state where the spring portions 31A are inserted in cylindrical members 25A, the board-side electrode portions 31 are held by the first frame 25. The cylindrical members 25A are portions integrally formed with a resin member assembled with the first frame 25.

Further, the other end sides of the spring portions 31A in the longitudinal direction, that is, the opposite sides to the ring portions 31B are in contact with terminal portions 29A provided to the first electric board 29. Therefore, the electrical contact portions 31B are electrically connected to the first electric board 29 through the spring portions 31A and the terminal portions 29A.

Meanwhile, the plurality of image-formation-side electrode portions 33 is held by the frame of the belt unit 13 and the drawer casing 21A. These image-formation-side electrode portions 33 are electrodes for supplying electric power to the process units 7, the transfer rollers 15, and so on.

3. Features of Image Forming Apparatus according to Present Exemplary Embodiment In the present exemplary embodiment, even if an external force acts on a ring portion 31B and adjacent portions of the wire 31C shift in the direction L3 perpendicular to the center line L2, the inner portion 31E or the outer portion 31F is locked to the adjacent portions of the wire 31C. Therefore, it is possible to suppress the adjacent portions of the wire from being twisted and shifting to intersect with each other.

For example, in a case where one ring of two rings configuring the ring portion 31B shifts inward with respect to the other ring, a corresponding outer portion 31F is locked to the other ring. On the contrary, in a case where one ring shifts outward with respect to the other ring, a corresponding inner portion 31E is locked to the other ring. For this reason, it is possible to suppress the adjacent portions of the wire from being twisted and shifting to intersect with each other.

Therefore, it is possible to obtain an electrode capable of suppressing adjacent portions of a wire from shifting to be twisted even if an external force acts on an electrical contact portion, that is, a ring portion 31B.

A feature of the present exemplary embodiment is that the inner portion 31E and the outer portion 31F deviate with respect to the ring portion 31B in a direction perpendicular to the center line. Therefore, the inner portion 31E and the outer portion 31F is configured to be provided within the thickness T of the ring portion 31B, that is, a portion of the ring portion 31B parallel to the center line L2.

Another feature of the present exemplary embodiment is that the outer portion 31F connects the spring portion 31A and the ring portion 31B. Therefore, it is possible to easily configure the outer portion 31F by using a portion rising from the spring portion 31A to the ring portion 31B.

Second Exemplary Embodiment

Figures 8A, 8B:
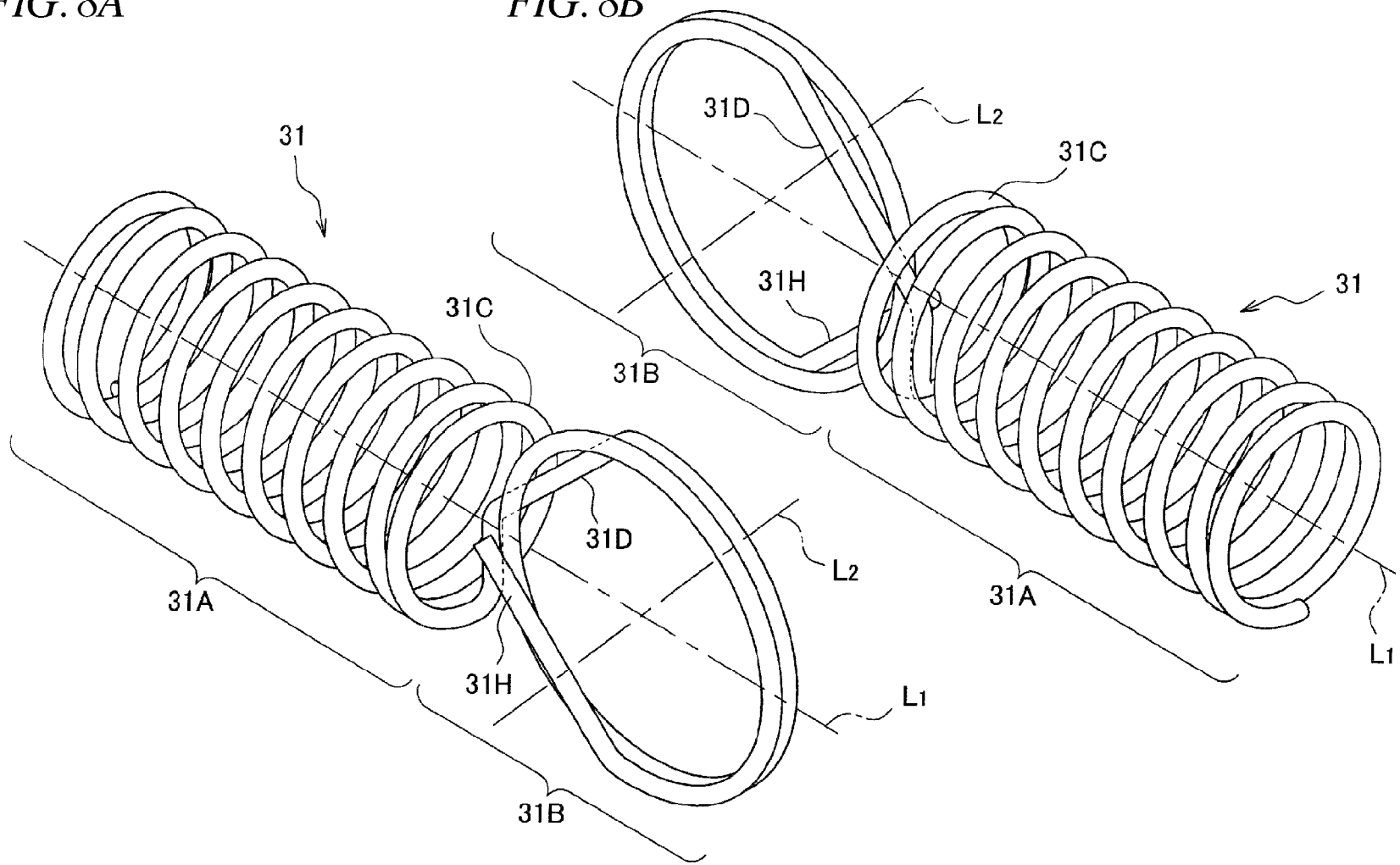
FIG. 8 (8A, 8B) is a perspective view illustrating a board-side electrode portion according to a second exemplary embodiment of the present invention.

In the above-mentioned exemplary embodiment, the straight portion 31D is provided only to the portion connecting the spring portion 31A and the ring portion 31B. However, in the present exemplary embodiment, as shown in FIG. 8 (8A, 8B), a straight portion 31D is also provided to the terminal end side of the ring portion 31B. In other words, in the present exemplary embodiment, straight portions 31D are provided to the terminal end side and start end side of the ring portion 31B.

Third Exemplary Embodiment

In the above-mentioned exemplary embodiments, the inner portion 31E and the outer portion 31F are connected to each other in a straight shape. However, the present exemplary embodiment shows an example in which each of the inner portion 31E and the outer portion 31F is curved as shown in FIG. 9.

Figure 9:
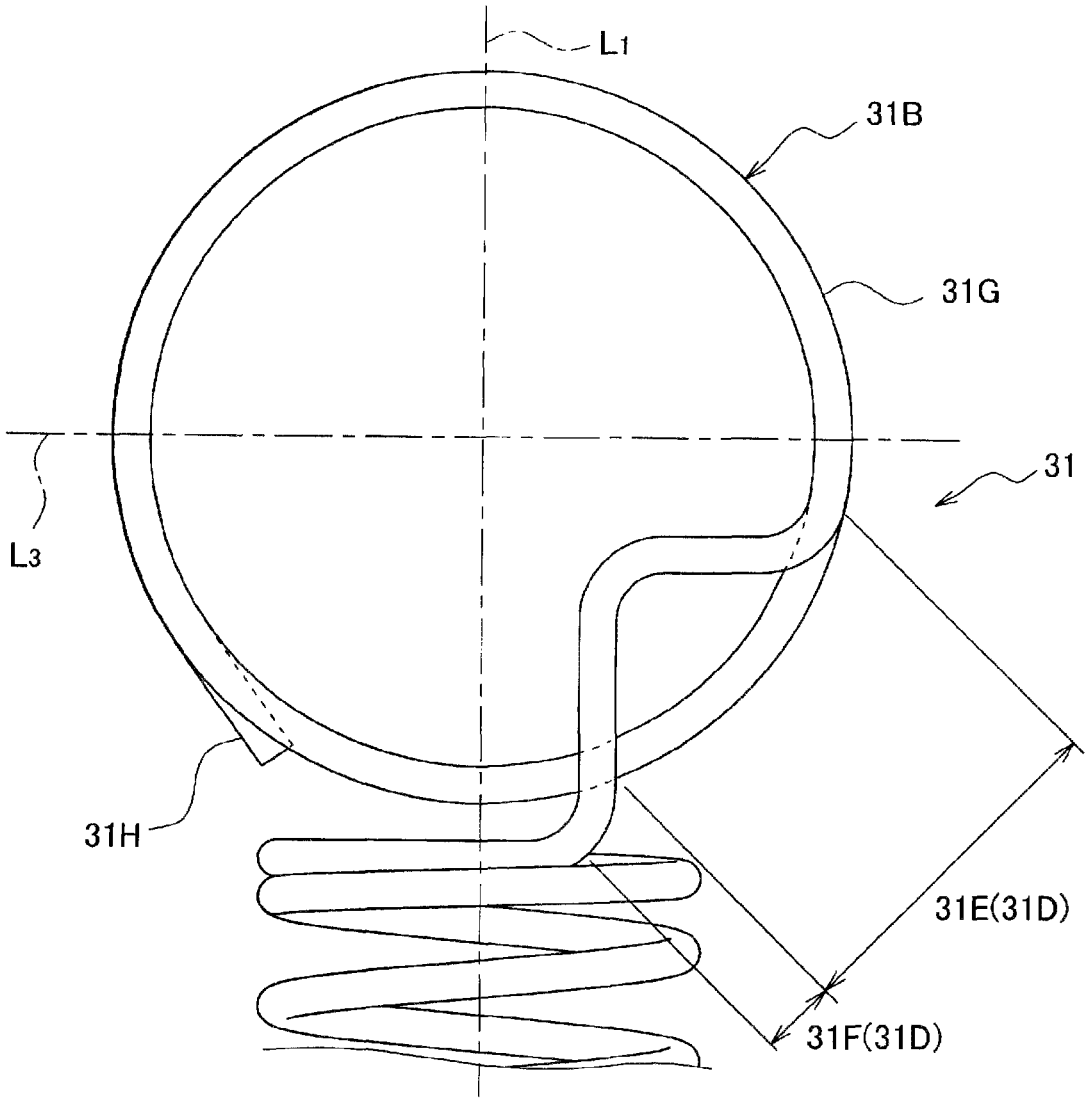
FIG. 9 is an enlarged view illustrating a ring portion 31B according to a third exemplary embodiment of the present invention.

Further, as shown in FIG. 9, each of the inner portion 31E and the outer portion 31F is bent in an L shape. However, the present exemplary embodiment is not limited thereto. For example, each of the inner portion 31E and the outer portion 31F may be curved in an arc shape.

It is to be noted that, also in the present exemplary embodiment, the portion connecting the inner portion 31E and the outer portion 31F is straight and intersects with the ring portion 31B in a contact state, and the inner portion 31E and the outer portion 31F deviate with respect to the ring portion 31B in the direction L3 perpendicular to the center line L2.

Other Exemplary Embodiments

In the above-described exemplary embodiments, the inner portion 31E and the outer portion 31F are connected to each other in a straight shape. However, the present invention is not limited thereto. For example, the inner portion 31E and the outer portion 31F may be connected via an arc portion forming a part of the ring portion 31B. In other words, the outer portion 31F may be provided, for example, at a position deviated with respect to the inner portion 31E by 90 degrees.

Further, in the second exemplary embodiment, to the terminal end side and start end side of the ring portion 31B, the straight portions 31D are provided. However, a straight portion 31D may be provided only to the terminal end side of the ring portion 31B.

Also, the image forming apparatus according to the above-described exemplary embodiments is a direct tandem type image forming apparatus. However, the present invention is not limited thereto, but can be applied to image forming apparatuses of other types.

Also, the present invention should not be limited to the above-described exemplary embodiments, but may be embodied in various forms within the scope of the invention described in the claims.

What is claimed is:

1. An electrode for an image forming apparatus, the electrode comprising:

an elastically deformable spring portion that is formed in a cylindrical shape by spirally winding a wire;

a ring portion that is an electrical contact portion having an annular shape and provided to one end side of the spring portion in an axial direction of the spring portion, the ring portion being formed by winding the wire around a center line, which intersects with the axial direction of the spring portion, at least twice;

an inner portion that is formed by the wire forming the ring portion and is positioned at an inside of the ring portion; and an outer portion that is formed by the wire forming the ring portion and is positioned at an outside of the ring portion;

wherein the inner portion and the outer portion are continuously connected to each other; and wherein a portion connecting the inner portion and the outer portion is formed in a straight shape.

2. The electrode for an image forming apparatus according to claim 1, wherein the inner portion and the outer portion deviate with respect to the ring portion in a direction perpendicular to the center line.

3. The electrode for an image forming apparatus according to claim 1, wherein the outer portion connects the spring portion and the ring portion.

4. The electrode for an image forming apparatus according to claim 1, wherein the inner portion is formed in a straight shape and includes a string portion connecting two different points of the ring portion.

5. The electrode for an image forming apparatus according to claim 1, wherein the outer diameter of the ring portion is larger than the outer diameter of the spring portion.

6. The electrode for an image forming apparatus according to claim 1, wherein a value obtained by dividing an average diameter of the ring portion by a wire diameter of the wire is 15 or greater.

7. The electrode for an image forming apparatus according to claim 1, wherein the inner portion and the outer portion are provided at the spring portion side with respect to the center of the ring portion.

8. The electrode for an image forming apparatus according to claim 1, wherein the spring portion, the ring portion, the inner portion and the outer portion are configured by bending a piece of wire.

9. An image forming apparatus comprising:

an apparatus main body;

a process unit that is detachably mounted to the apparatus main body and is configured to form an image on a sheet; and the electrode for the image forming apparatus according to claim 1, which is configured to electrically connect the process unit and the apparatus main body.

10. An electrode for an image forming apparatus, the electrode comprising:

an elastically deformable spring portion that is formed in a cylindrical shape by spirally winding a wire;

a ring portion that is an electrical contact portion having an annular shape and provided to one end side of the spring portion in an axial direction of the spring portion, the ring portion being formed by winding the wire around a center line, which intersects with the axial direction of the spring portion, at least twice;

an inner portion that is formed by the wire forming the ring portion and is positioned at an inside of the ring portion; and an outer portion that is formed by the wire forming the ring portion and is positioned at an outside of the ring portion;

wherein the inner portion and the outer portion deviate with respect to the ring portion in a direction perpendicular to the center line.

11. The electrode for an image forming apparatus according to claim 10, wherein the outer portion connects the spring portion and the ring portion.

12. The electrode for an image forming apparatus according to claim 10, wherein the inner portion is formed in a straight shape and includes a string portion connecting two different points of the ring portion.

13. The electrode for an image forming apparatus according to claim 10, wherein the outer diameter of the ring portion is larger than the outer diameter of the spring portion.

14. The electrode for an image forming apparatus according to claim 10, wherein a value obtained by dividing an average diameter of the ring portion by a wire diameter of the wire is 15 or greater.

15. The electrode for an image forming apparatus according to claim 10, wherein the inner portion and the outer portion are provided at the spring portion side with respect to the center of the ring portion.

16. An electrode for an image forming apparatus, the electrode comprising:

an elastically deformable spring portion that is formed in a cylindrical shape by spirally winding a wire;

a ring portion that is an electrical contact portion having an annular shape and provided to one end side of the spring portion in an axial direction of the spring portion, the ring portion being formed by winding the wire around a center line, which intersects with the axial direction of the spring portion, at least twice;

an inner portion that is formed by the wire forming the ring portion and is positioned at an inside of the ring portion; and an outer portion that is formed by the wire forming the ring portion and is positioned at an outside of the ring portion;

wherein the outer portion connects the spring portion and the ring portion.

17. The electrode for an image forming apparatus according to claim 16, wherein the inner portion is formed in a straight shape and includes a string portion connecting two different points of the ring portion.

18. The electrode for an image forming apparatus according to claim 16, wherein the outer diameter of the ring portion is larger than the outer diameter of the spring portion.

19. The electrode for an image forming apparatus according to claim 16, wherein a value obtained by dividing an average diameter of the ring portion by a wire diameter of the wire is 15 or greater.

20. The electrode for an image forming apparatus according to claim 16, wherein the inner portion and the outer portion are provided at the spring portion side with respect to the center of the ring portion.

* * * * *